US009462874B1

(12) United States Patent
Samuel

(10) Patent No.: US 9,462,874 B1
(45) Date of Patent: Oct. 11, 2016

(54) PORTABLE AND INSULATED MEAL STORAGE ASSEMBLY

(71) Applicant: Mark Alan Samuel, Burlingame, CA (US)

(72) Inventor: Mark Alan Samuel, Burlingame, CA (US)

( * ) Notice: Subject to any disclaimer, the term of this patent is extended or adjusted under 35 U.S.C. 154(b) by 0 days.

(21) Appl. No.: 14/244,999

(22) Filed: Apr. 4, 2014

Related U.S. Application Data

(60) Provisional application No. 61/920,003, filed on Dec. 23, 2013.

(51) Int. Cl.
*A47J 39/00* (2006.01)
*A45F 3/02* (2006.01)
*A45C 13/02* (2006.01)

(52) U.S. Cl.
CPC *A45F 3/02* (2013.01); *A45C 13/02* (2013.01)

(58) Field of Classification Search
CPC ... F25D 3/08; F25D 2331/801; A45C 11/20; A45C 7/0077; A45C 13/02; A45C 5/06; A45C 7/0045; A45C 7/0086; A45C 2003/007
USPC ..... 62/457.1, 457.2, 457.5, 457.7, 447; 220/592.2, 528, 915.2, 529, 533
See application file for complete search history.

(56) References Cited

U.S. PATENT DOCUMENTS

| | | | | |
|---|---|---|---|---|
| 4,842,032 | A * | 6/1989 | Mastronardo | 206/308.1 |
| 5,011,241 | A * | 4/1991 | Horton et al. | 312/330.1 |
| 5,090,526 | A * | 2/1992 | Jacober | A45C 7/0077 190/107 |
| 5,630,537 | A * | 5/1997 | Sciacca | 224/629 |
| 6,237,776 | B1 * | 5/2001 | Mogil | 206/579 |
| 6,595,604 | B1 * | 7/2003 | Peterson | A01K 97/06 190/110 |
| 2003/0010780 | A1 * | 1/2003 | Redzisz | 220/6 |
| 2005/0056048 | A1 * | 3/2005 | Fuchs | 62/457.7 |
| 2009/0184143 | A1 * | 7/2009 | Witt | A45C 7/0059 224/153 |
| 2010/0258576 | A1 * | 10/2010 | Marquez | 220/737 |
| 2012/0321226 | A1 * | 12/2012 | Hansen | A45C 13/02 383/104 |

* cited by examiner

*Primary Examiner* — Shawn M Braden
(74) *Attorney, Agent, or Firm* — Hickman Palermo Becker Bingham LLP

(57) ABSTRACT

A portable, soft-shelled carrying device including: a) a front-opening, horizontally expandable compartment operable to accommodate an insulated meal storage assembly which holds stackable individual meal containers, and wherein said horizontally expandable compartment, when the meal storage assembly is removed, is thereby operable to retract horizontally into a collapsed position such that is it flush with the vertical alignment of the inner wall of the carry device, and; b) a plurality of pockets for storing non-perishables including any of the following: a book, a laptop or tablet computer, athletic apparel, and a beverage bottle.

10 Claims, 16 Drawing Sheets

PORTABLE AND INSULATED MEAL STORAGE ASSEMBLY

BENEFIT CLAIM

This application claims the benefit under 35 U.S.C. 119(e) of provisional application 61/920,003, filed en-Dec. 23, 2013, the entire contents of which is incorporated herein by reference for all purposes as if fully set forth herein.

FIELD OF THE INVENTION

The present invention relates to portable, soft-shelled carrying devices useful for having a front-opening, horizontally expandable compartment operable to accommodate an insulated meal storage assembly which holds stackable individual meal containers. In addition, the invention provides for a plurality of pockets or other soft compartments for storing non-perishables items like books, a laptop or tablet computer, athletic apparel, and a beverage bottle.

BACKGROUND OF THE INVENTION

In the work world of today, we have come a long way from carrying our lunch in a brown paper bag. Lunch pails and small coolers are widely popular means of carrying lunches. One of the major problems with current lunch pails and small coolers is that most of them have only a single carrying compartment without any sub-segmentation, thus making the contents stored therein difficult to organize and access. Further, many people would prefer to carry a meal plate or container, be it homemade or store bought, due to the availability of microwave ovens in work places. Such meal plates or containers can accommodate a complete array of foodstuffs for a balanced diet and proper apportionment for calorie-counting purposes. Most lunch pails and small coolers of today are not designed to carry such a meal plate or container, but rather random sandwiches, fruit, beverages, and a jumble of individual small packages.

DESCRIPTION OF THE PRIOR ART

The prior art patents have not adequately addressed the problems relating to providing a cost-effective, manufacturably-efficient, and user-friendly, compartmentalized soft-shelled insulated and portable carrying case.

U.S. Pat. No. 6,612,434, issued Sep. 2, 2003 to Redzisz, shows a sport tackle box bag for carrying multiple rectangular paralleled generally rigid tackle storage boxes. The box bag includes a lower section having a front flap for access to the lower section and an upper section having a top flap for access to the top section.

U.S. Pat. No. 5,403,095, issued Apr. 4, 1995 to Melk, claims a flexible cooler with a removeable insert, which is a thermally insulating carrier for preventing temperature change of heated or cooled items placed therein. The carrier includes a flexible bag-like container having a compartment therein and a generally rigid hollow tub-like liner member which is removably disposed in the compartment. The flexible container includes a side wall portion, a base portion, and a displaceable cover. At least the side wall portion and cover are constructed incorporating a flexible insulating material for providing an insulating effect. The hollow liner is integrally formed of a rigid, waterproof, and shatterproof material with side portions joined to a bottom portion. A mouth is formed around the top of the liner and is coincident with the container aperture. The liner improves the thermal characteristics, provides structural support for the flexible container, and prevents leakage of moisture from the flexible container.

U.S. Pat. Application #20020084206, published Jul. 4, 2002 by Protopapas, depicts a lunch box that comprises a plurality of stackable, interchangeable food tray assemblies that have compartments in them for the storage of foodstuffs and other items. These stackable, interchangeable food tray assemblies are housed in an enclosure with a lid to protect the contents and a handle to provide ease of transport by the user. The lunch box can be made in a variety of sizes to accommodate the needs of the user and to fit within various size refrigerators. The lunch box can include locking features to hinder unauthorized access to the contents.

U.S. Patent Application #20070186579, published Aug. 16, 2007 by Barker, discloses a cooler assembly directed to the temperature management of the cooler's contents by focusing on the cooling, movement, pressure and/or moisture within the cooler. Insofar as the contents of a cooler generally includes, for example, food, beverages, and coolants, the Barker cooler assembly stores the food, beverages, and coolants in a manner that addresses cooling, reduce movement, relieve pressure and/or isolate moisture within the cooler.

The present invention is distinguished and advantageous over the prior art in general, and the above cited patents in particular, because it provides a convenient and organized soft-shelled carrying device which has a front-opening, horizontally expandable compartment operable to accommodate an insulated meal storage assembly which has at least one swivel partition which holds stackable individual meal containers. In addition, the invention provides for a plurality of pockets or other soft compartments for storing non-perishable items like books, a laptop or tablet computer, athletic apparel, and a beverage bottle.

OBJECTIVES AND ADVANTAGES OF THE INVENTION

It is thus an object of the invention to provide a soft-shelled carrying device which has a front-opening, horizontally expandable compartment operable to accommodate an insulated meal storage assembly which holds stackable individual meal containers.

It is a further object of the invention to provide adjoining soft-shelled pockets or compartments for storing non-perishables items like books, a laptop or tablet computer, athletic apparel, and a beverage bottle.

A full front zippered opening enables full access to the portable meal storage assembly operable for sliding food containers in and out with a top zippered insulated opening enables full access to the insertable coolant or heating packets.

An advantage of the present invention is that it improves the organizational management of the contents and stores both non-perishables like apparel and perishables like food, in a manner that would improve accessibility, temperature control and reduce undesired movement of the contents therein.

Another advantage of the present invention is that it accommodates a portable and insulated meal storage assembly with the capacity to include a plurality of individual meals for people who need to eat frequently, such as weight lifters, dieters, or to provide separate meals for a family outing.

Another advantage of the present invention is that it provides separations between the food storage assembly and the non-perishables, to prevent them from either pressing on each other, being jostled and thereby disorganized.

Another advantage of the present invention is that it is portable, said portability comprising handles, shoulder straps, and/or a fastening strap so that the invention can be removeably affixed to a telescoping handle of rolling luggage.

SUMMARY OF THE INVENTION

The presently claimed invention achieves the advantages and objectives recited hereinabove, by providing an improved infrastructure for an insulated meal storage assembly.

An embodiment of the invention comprises: a) a portable, soft-shelled carrying device with a front-opening, horizontally expandable compartment operable to accommodate an insulated meal storage assembly which holds stackable individual meal containers, and wherein said horizontally expandable compartment, when the meal storage assembly is removed, is thereby operable to retract horizontally into a collapsed position such that is it flush with the vertical alignment of the inner wall of the carry device, and; b) a plurality of pockets for storing non-perishables comprising any of the following: a book, a laptop or tablet computer, athletic apparel, and a beverage bottle.

Another embodiment of the invention comprises the horizontally expandable compartment comprising dimensions, when in the expanded position, of essentially: 7½ inches horizontally; 4½ inches vertically, and; 9 inches in width.

Another embodiment of the invention comprises a portable and insulated meal storage assembly, comprising: a) a main compartment including a compartment floor, an openable front wall, a back wall, an openable top wall, and two opposing side walls, wherein extending from the back wall to the front wall is at least one swivel partition which is permanently affixed to the back wall via a fabric hinge and which is removeably affixed to a Velcro® seam on the compartment floor near the front wall; b) a fabric mesh pouch affixed to the internal surface of the back wall; c) a fabric mesh pouch affixed to the internal surface of the top wall, and; d) a flexible pouch affixed to the exterior surface of at least one of the side walls.

In another embodiment of the invention, a fastening strap is affixed to the exterior surface of the back wall.

In another embodiment of the invention, a handle and a shoulder strap are affixed to the exterior surface of the top wall.

In another embodiment of the invention, a sub-pocket is affixed to the exterior surface of the front wall.

In another embodiment of the invention, being permanently affixed comprises any one of the following: stitching; sonic welding, and; adhesive adherence.

In another embodiment of the invention, being removeably affixed comprises: mating Velcro® surfaces, and; mating snap surfaces.

In another embodiment of the invention, the fabric mesh pouch affixed to the internal surface of the back wall is operable to store temperature adjustment packets comprising any one of the following: a cooling chemical sealed within a plastic pouch, and; a heating chemical sealed within a plastic pouch.

In another embodiment of the present invention, the swivel partition comprises any of the following: soft padded thermally insulated material, and; hard-shell thermally insulated plastic.

In another embodiment of the present invention, the insulated material comprises any of the following: thermal foam; polyvinyl chloride, and; a foil lining.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

DETAILED DESCRIPTION OF THE INVENTION

The present invention may be described herein in terms of various functional elements as depicted in the attached drawings, configurations and described embodiments. It should be appreciated that such functional elements may be realized by any number of similar elements configured according to this invention to perform the specified functions. Thus, it should be appreciated that the particular implementations shown and described herein are illustrative of the invention and its preferred mode and are not intended to otherwise limit the scope of the present invention in any way. Indeed, for the sake of brevity, conventional elements of a soft shell cooler may not be described in detail herein. Furthermore, the various figures contained herein are intended to represent illustrative functional embodiments of the invention, and that many alternative or equivalent configurations, elements, and structures are intended to be within the scope of the present invention. It should further be noted that the order of the elements in the attached drawings, specification and claims are not intended as limitations and the drawings, specification and claims may be configured in other orders without deviating from the scope and spirit of the present invention.

It is noted that the embodiment of the meal storage assembly described hereinbelow in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

The present invention comprises some or all the following components, although any one embodiment of the invention may comprise any subset of the following components:

Soft Shell Cooler (or Meal Storage Assembly) 40
Main Central Compartment (or Main Compartment) 29
Main Front Opening Flap or Wall 14
Main Front Closure 14*a*
Sub-Front Opening Flap 31
Sub-Front Closure 31*a*
Sub-Front Opening Pocket 31*b*
Shoulder Strap 13
External Pouch 21
Main Compartment Internal Pouch 34
Side Chamber (or Side Pouch) 32
Handle 33
Top Opening Flap or Wall 17
Top Closure 17*a*
Top Opening Flap (or Wall) Internal Pouch 17*b*
Swivel Partition 6
Swivel Partition Hinge 6*a*
Swivel Partition Fastener 6*b*
Fastening Strap 35
Rear Pouch 36
Side Wall 37
Back Wall 38
Compartment Floor 41
Carrying Device 50
Expandable Compartment Front Flap 51
Expandable Compartment Front Flap Closure 52
Expandable Compartment 53
Expandable Compartment Side Wall 53*b*
Expandable Compartment Back Wall 53*c*
Expandable Compartment Bottom Wall 53*a*

Figure 1:
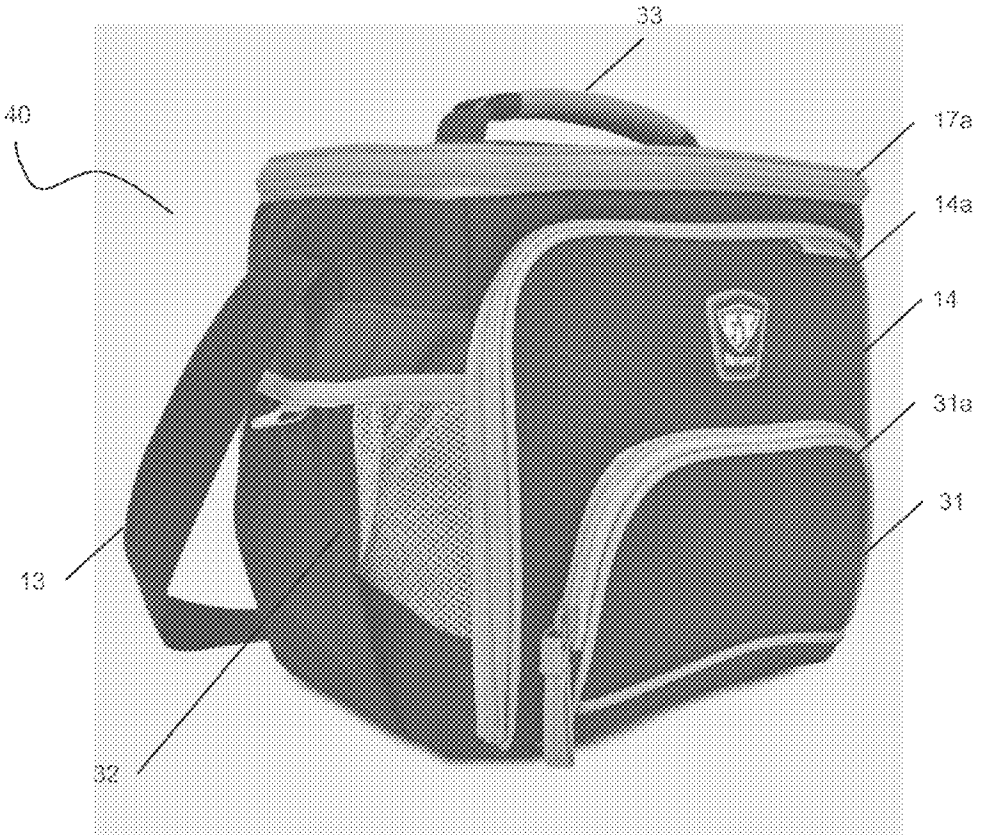
FIG. 1 is a perspective view of an exemplary embodiment of the meal storage assembly of the present invention in a fully closed position.
Figure 2:
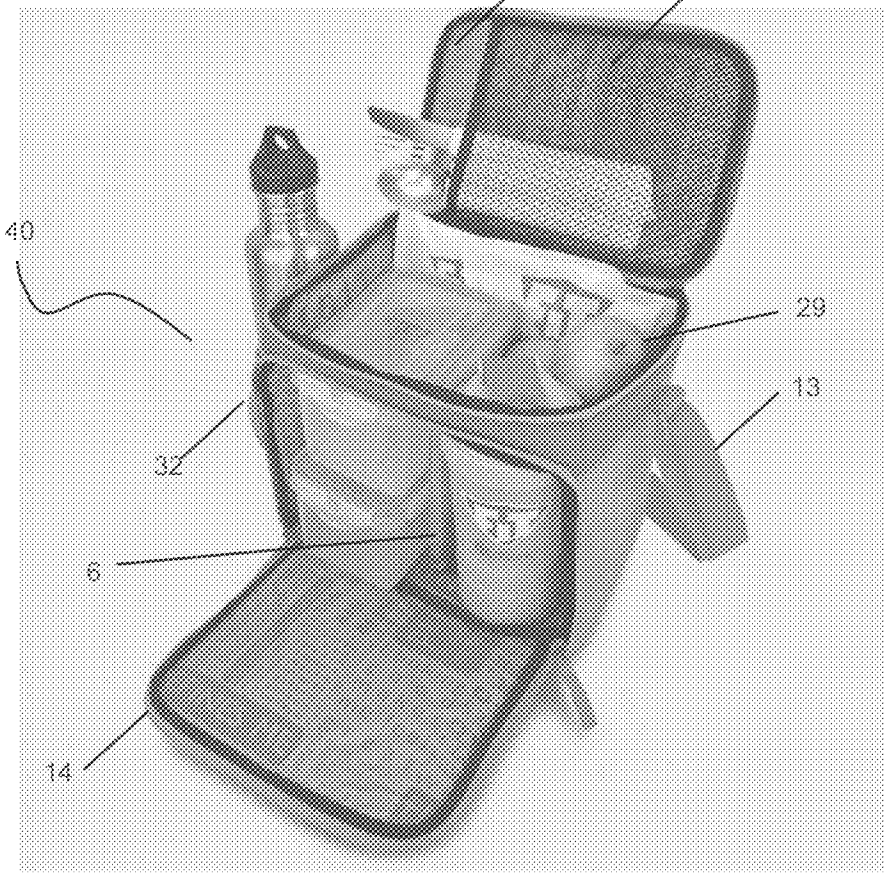
FIG. 2 is a perspective view of an embodiment of the meal storage assembly of the present invention in a fully opened position.
Figure 3:
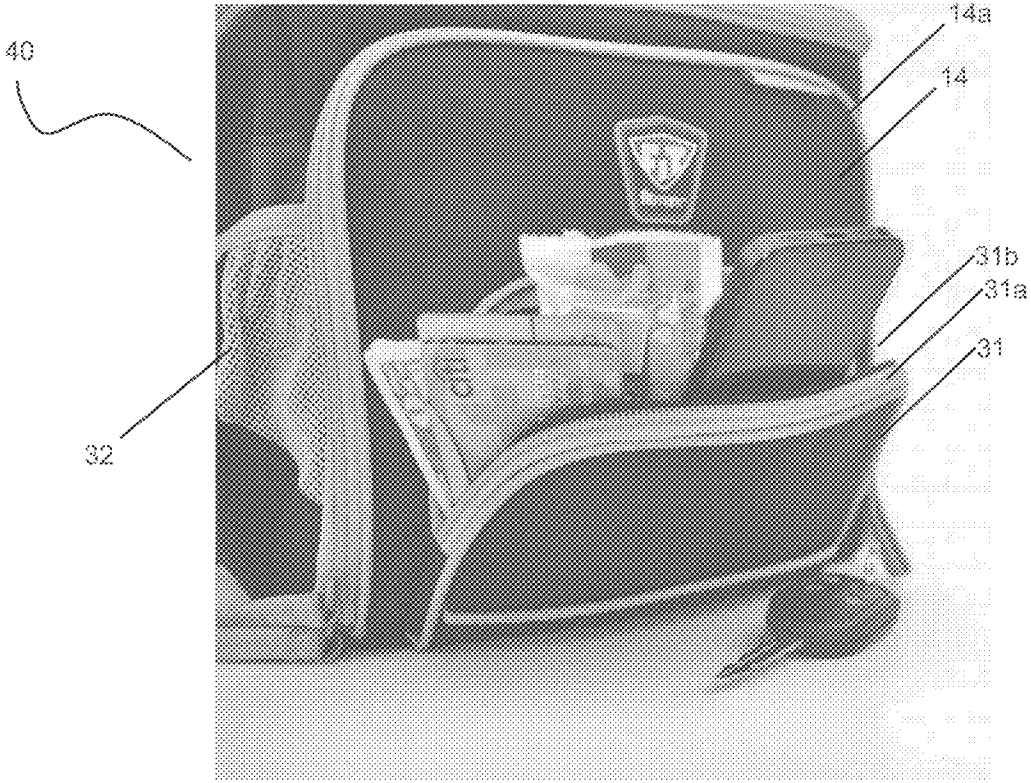
FIG. 3 is a frontal view of the meal storage assembly of the present invention showing the sub-front opening pocket in the opened position.
Figure 5:
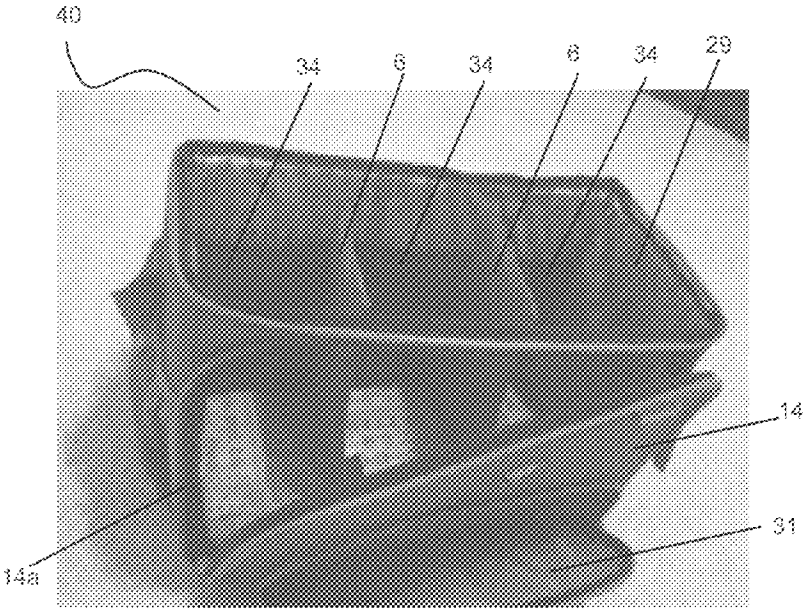
FIG. 4 and FIG. 5 are top views of an exemplary embodiment of the meal storage assembly of the present invention showing the top flap open, the front flap partially open, and the sub-front opening pocket partially open, and the swivel partitions extended to adhere to their Velcro® affixtures.

FIG. 2 is an illustrative depiction of the Meal Storage Assembly 40, with a Main Central Compartment 29 accommodating meal trays, a blender bottle, and fruit, separated by a Swivel Partition 6. The Rear Pouch 36 accommodates cooling packs, and the Top Opening Flap Internal Pouch 17*b* accommodates utensils. The Side Pouch 32 accommodates a water bottle. There is a Shoulder Strap 13. The Main Front Opening Flap 14 can be fully opened to allow easy access to contents from the front, while the Top Opening Flap 17 can be fully opened to allowed easy access to contents from the top.

Figure 4:
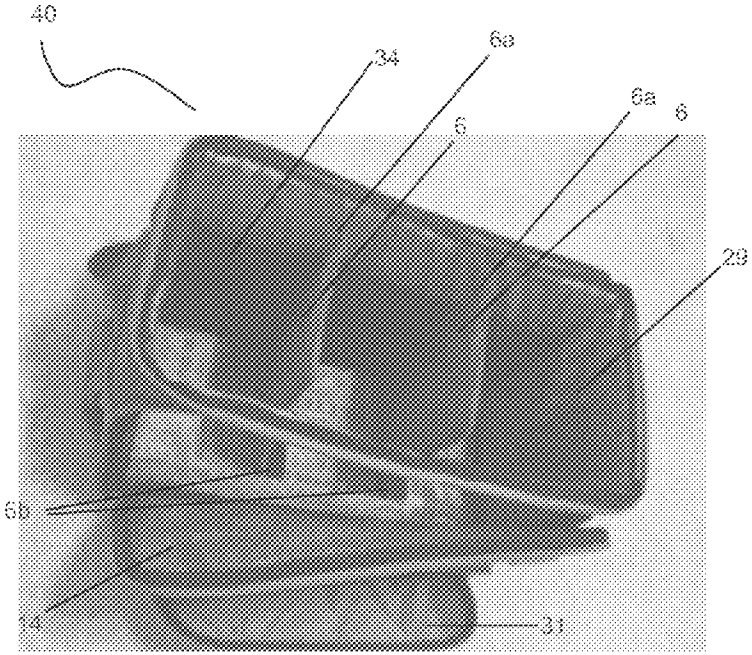
Figure 6:
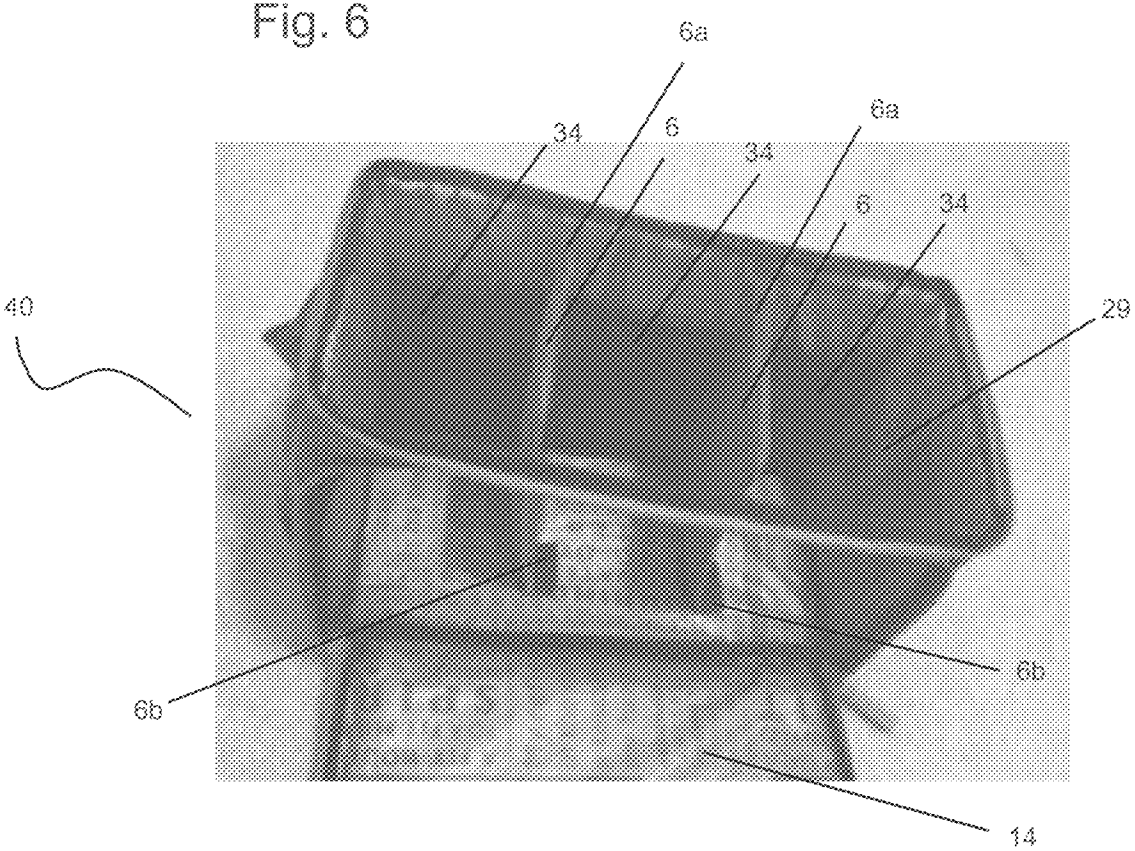
FIG. 6 is a top view of an exemplary embodiment of the meal storage assembly of the present invention showing the top flap open, the front flap open, and the swivel partitions extended to adhere to their Velcro® affixtures.
Figure 8:
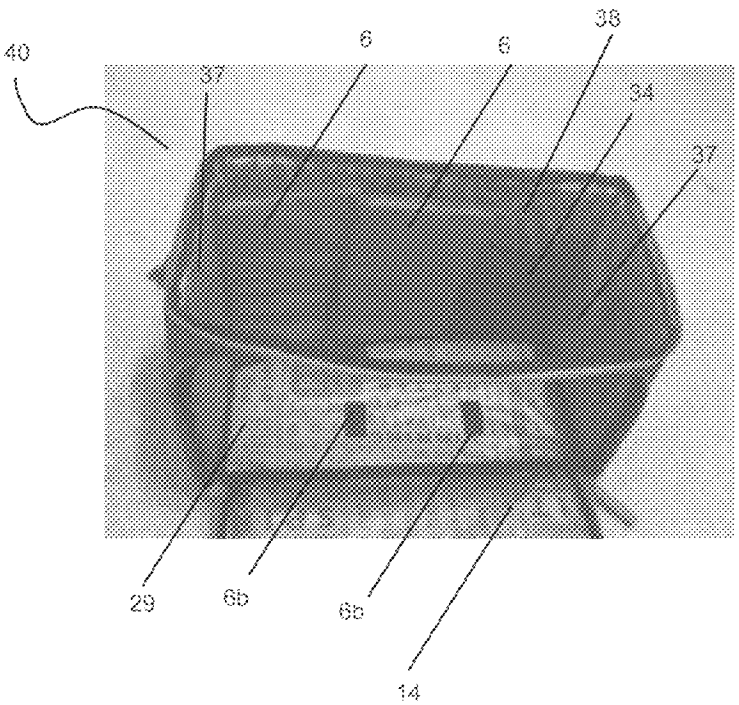
FIG. 8 is a top view of an exemplary embodiment of the meal storage assembly of the present invention showing the top flap open, the front flap open, and both of the swivel partitions folded toward the back wall to make room for larger meal containers.
Figure 7:
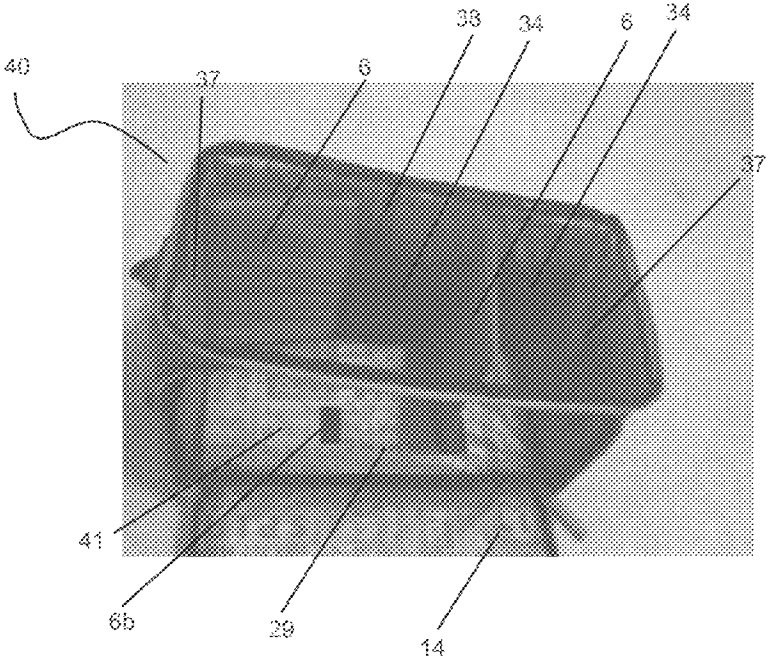
FIG. 7 is a top view of an exemplary embodiment of the meal storage assembly of the present invention showing the top flap open, the front flap open, and one of the swivel partitions extended to adhere to its Velcro® affixture, while the other swivel partition is folded toward the back wall to make room for larger meal containers.
Figure 10:
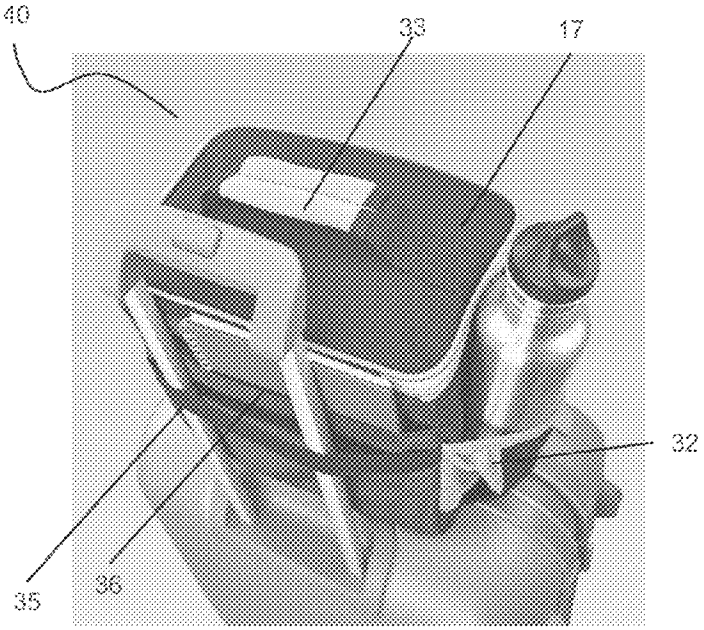
FIG. 10 is a top rear view of an exemplary embodiment of the meal storage assembly of the present invention showing the the handle, the fastening strap around a telescoping arm of rolling luggage, and the rear pouch.
Figure 9:
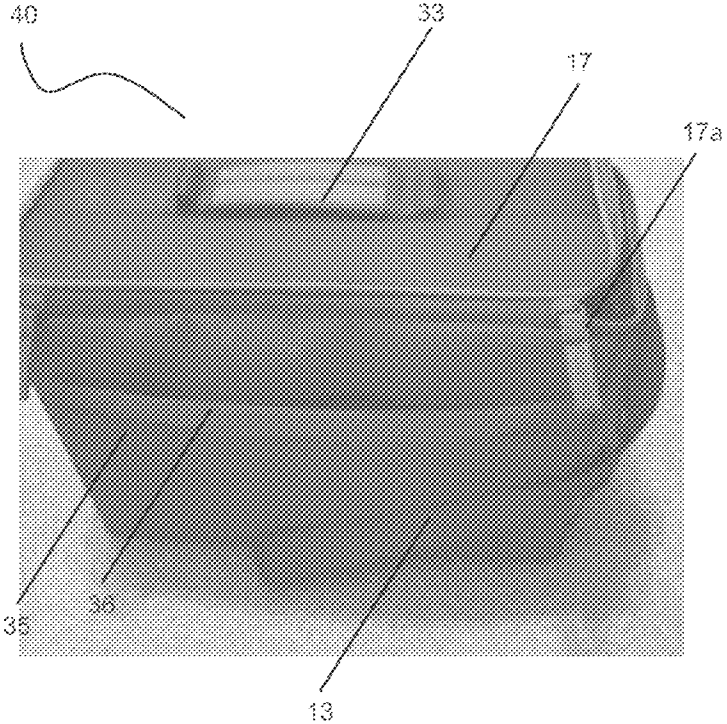
FIG. 9 is a rear view of an exemplary embodiment of the meal storage assembly of the present invention showing the shoulder strap, the handle, the fastening strap, and the rear pouch.
Figure 11:
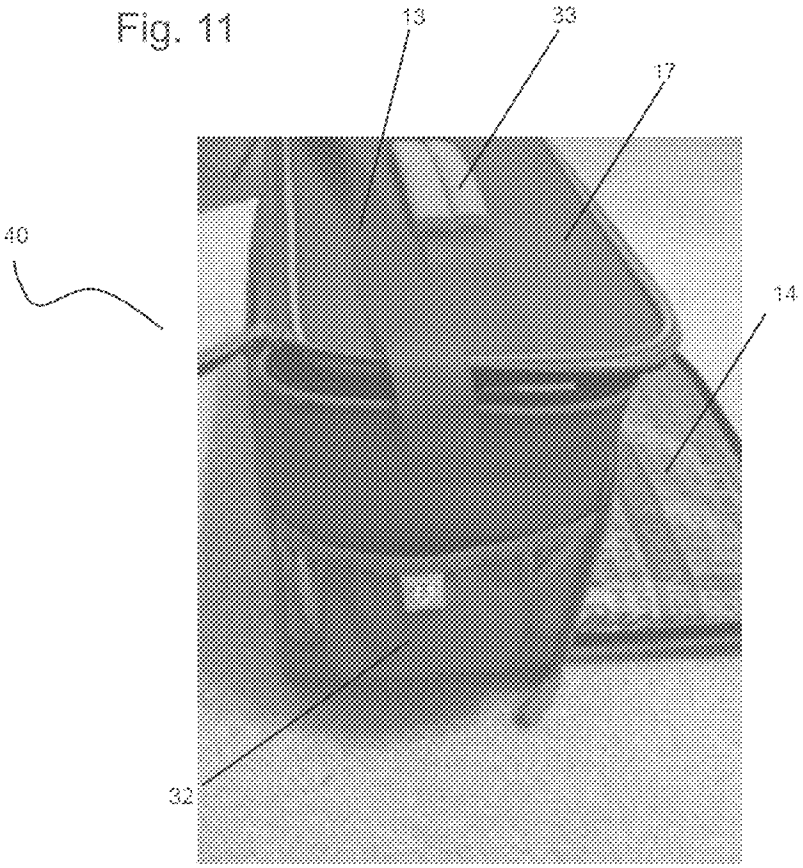
FIG. 11 is a side view of an exemplary embodiment of the meal storage assembly of the present invention showing the shoulder strap, the handle, and the side pouch.
Figure 12:
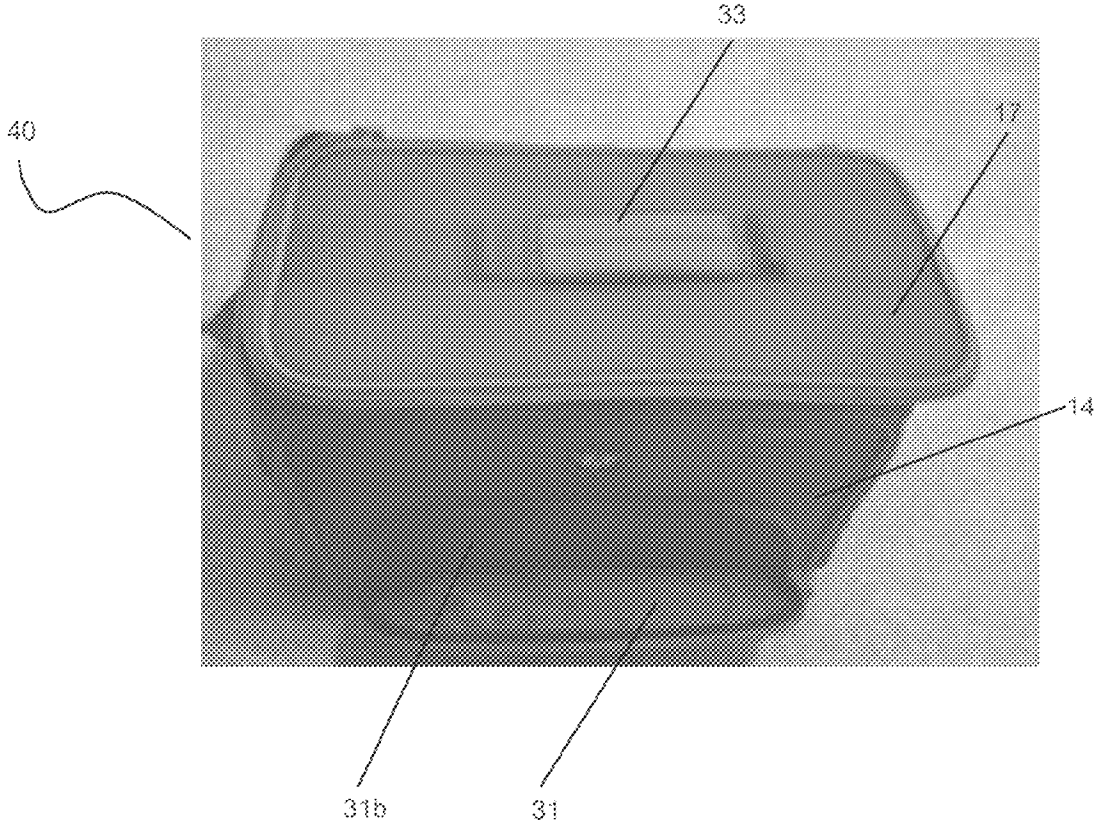
FIG. 12 is a top front view of an exemplary embodiment of the meal storage assembly of the present invention showing the top flap closed, the front flap closed, and the sub-front flap opened.
Figure 13:
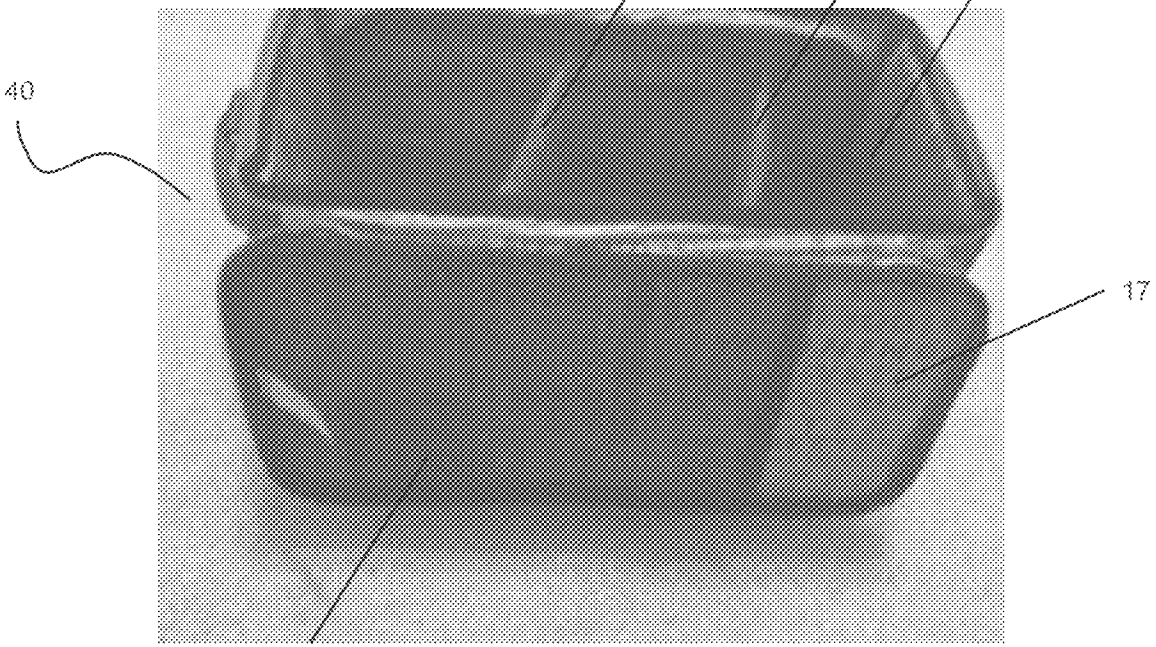
FIG. 13 is a top rear view of an exemplary embodiment of the meal storage assembly of the present invention showing the top opening flap internal pouch, and the swivel partitions.
Figure 14:
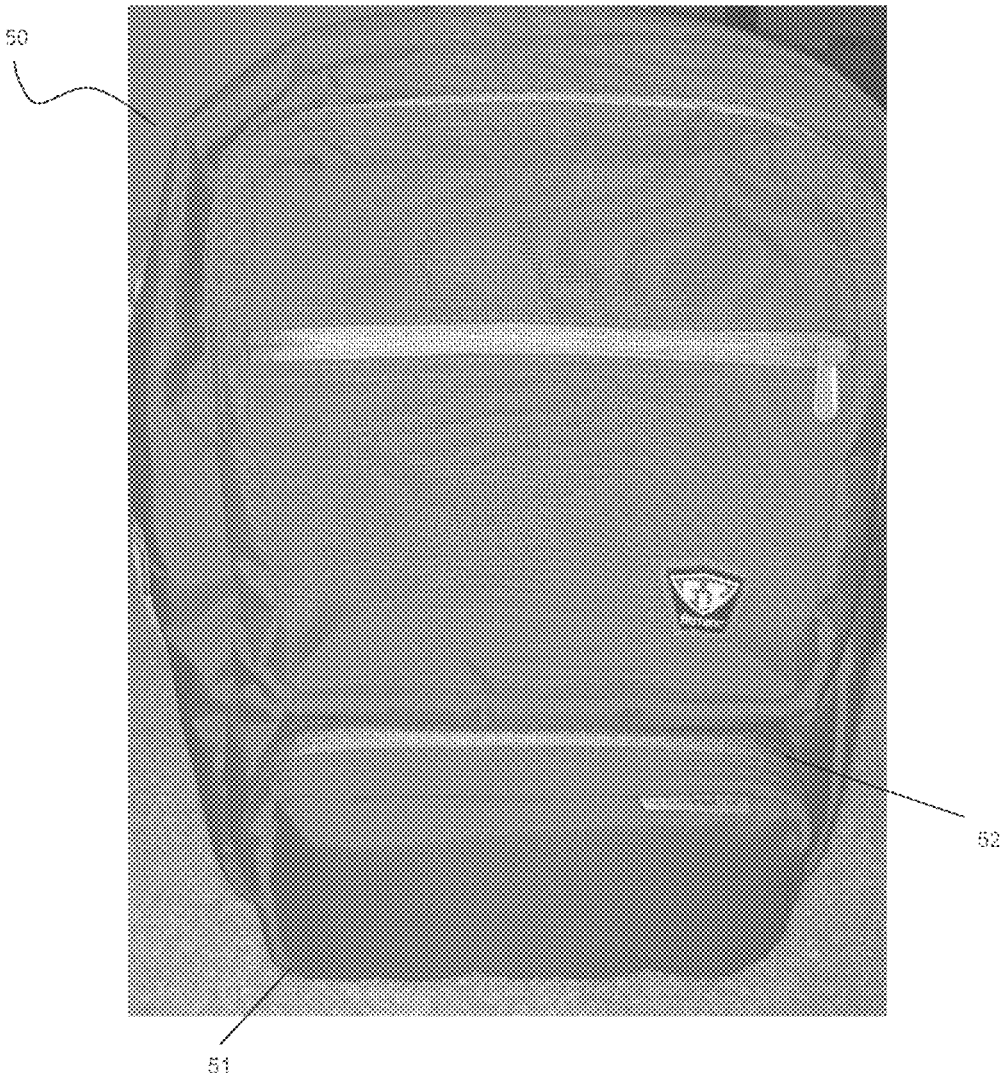
FIG. 14 is a front view of an exemplary embodiment of the carrying device showing the expandable compartment front flap in the closed position and secured by the expandable compartment front flap closure, in this instance a zipper.
Figure 15:
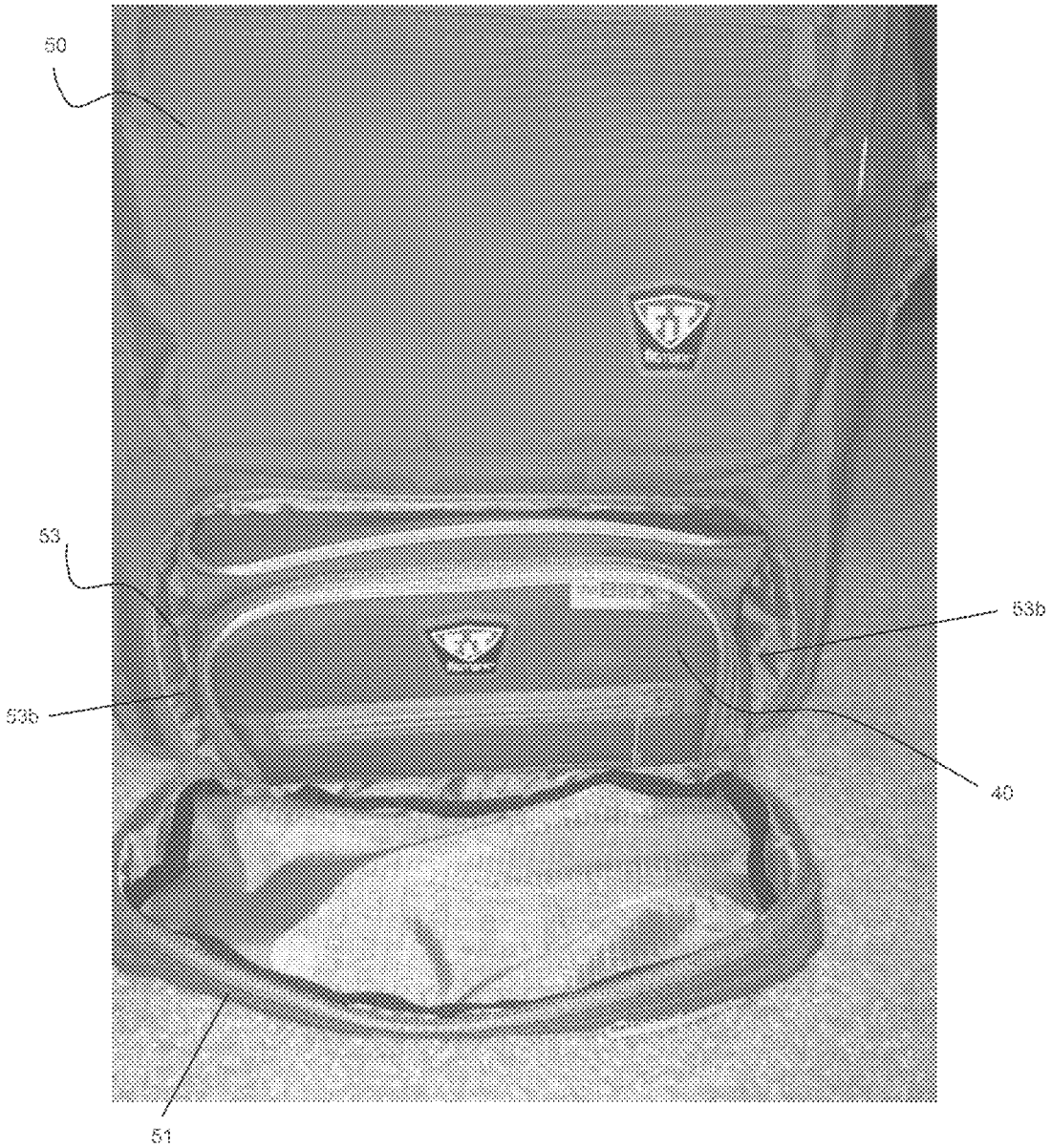
FIG. 15 is a front view of an exemplary embodiment of the carrying device showing the expandable compartment front flap in the open position with the meal storage assembly viewable therein.
Figure 16:
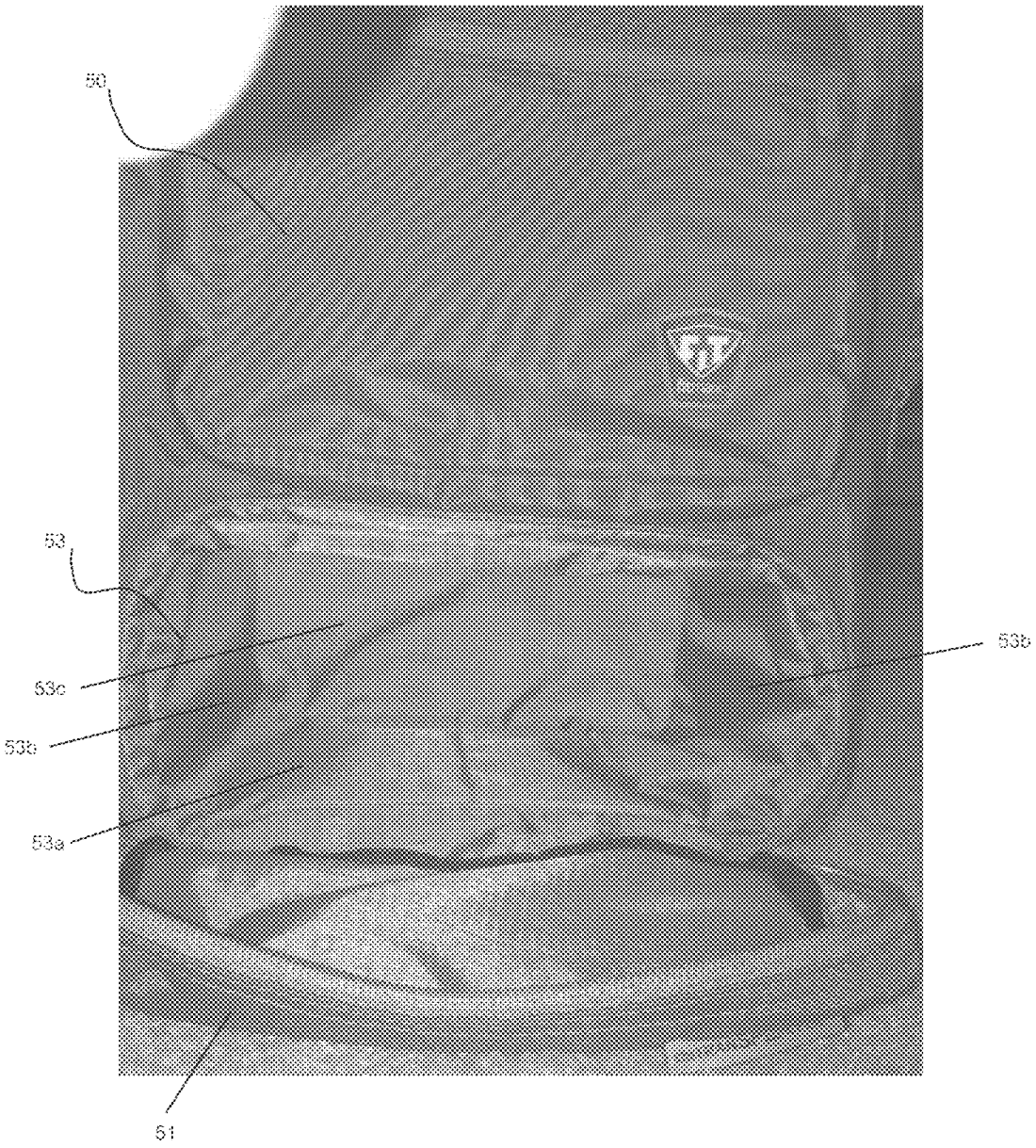
FIG. 16 is a front view of an exemplary embodiment of the carrying device showing the expandable compartment front flap in the open position, without the meal storage assembly therein, and with the side, bottom, and back walls of the expandable compartment viewable.
Figure 17:
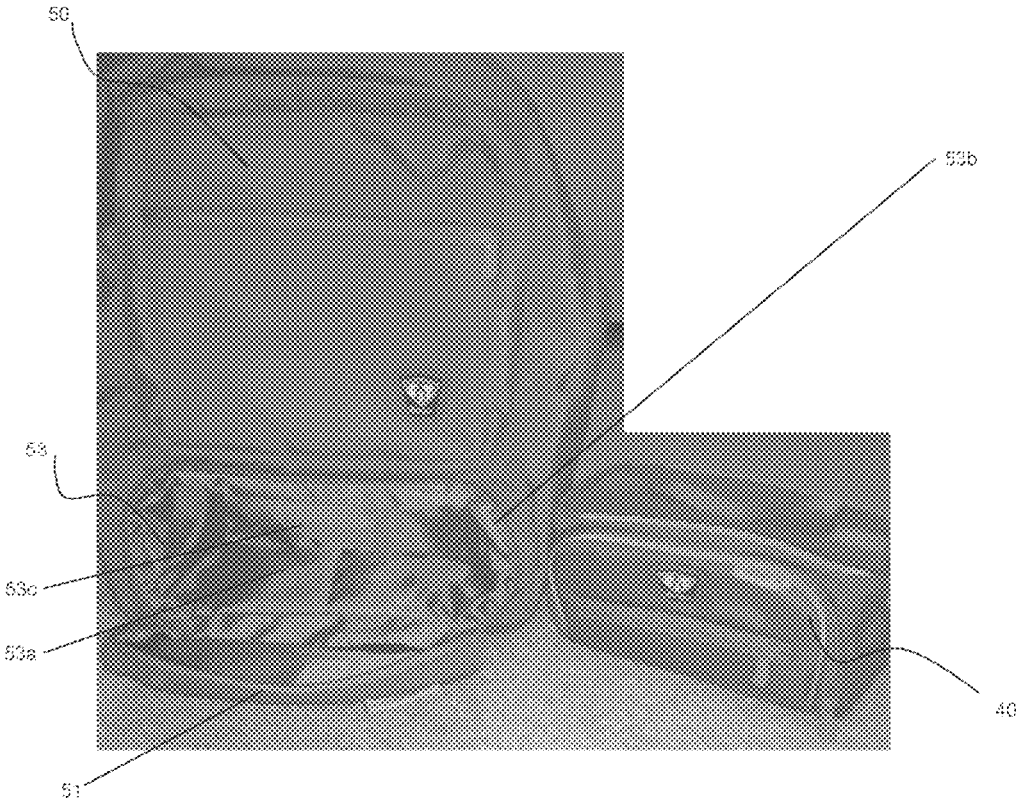
FIG. 17 is a front view of an exemplary embodiment of the carrying device showing the expandable compartment front flap in the open position, without the meal storage assembly therein, and with the side, bottom, and back walls of the expandable compartment viewable. Also shown is the meal storage assembly viewed apart from and beside the carrying device.
Figure 18:
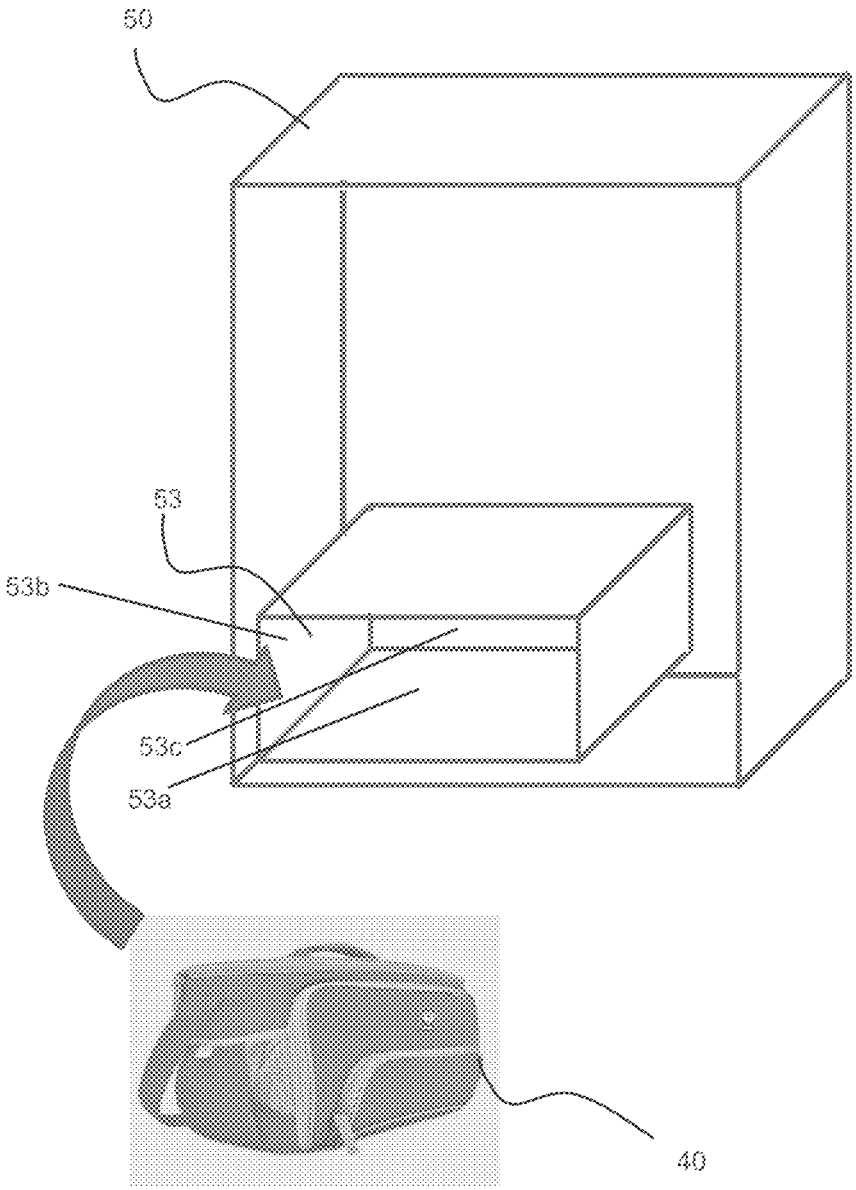
FIG. 18 is a front view of an exemplary embodiment of the carrying device showing the expandable compartment in the expanded position, without the meal storage assembly therein, and with the side, bottom, and back walls of the expandable compartment viewable. Also shown is the meal storage assembly being inserted into the expandable compartment, as viewed apart from and beside the carrying device.
Figure 19:
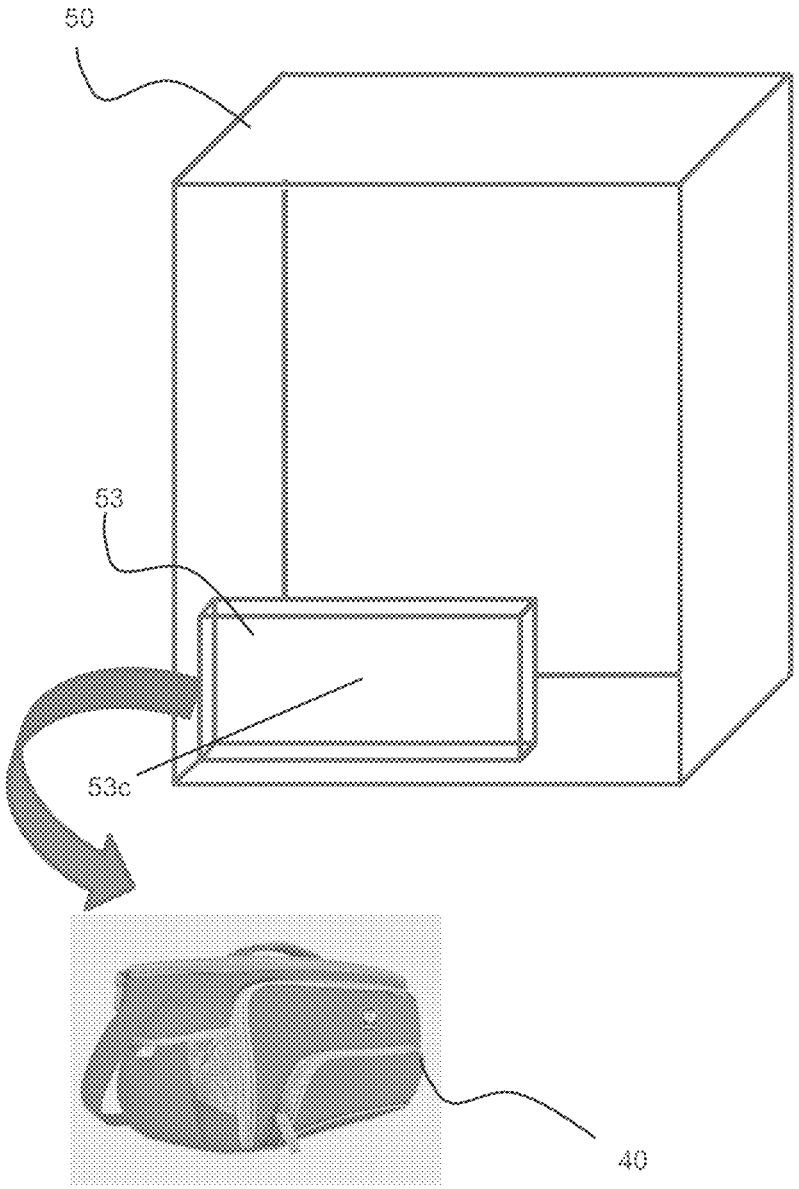
FIG. 19 is a front view of an exemplary embodiment of the carrying device showing the expandable compartment in the collapsed position, without the meal storage assembly therein. Also shown is the meal storage assembly being removed from the expandable compartment, as viewed apart from and beside the carrying device.

FIG. 4 is an illustrative depiction of the Meal Storage Assembly 40 with a Main Central Compartment (or Main Compartment) 29. The Main Compartment Internal Pouch 34 has three segments, each operable to accommodate a cooling or warming packet (not shown). Each of the two Swivel Partitions 6 is permanently affixed to the Back Wall 38 via a Swivel Partition Hinge 6*a*. Each Swivel Partition is further removeably affixed to the Compartment Floor 41 via a Swivel Partition Fastener 6*b*.

Although the description above contains many specificities, these should not be construed as limiting the scope of the invention but as merely providing illustrations of some of the presently illustrated embodiments of this invention. Thus the scope of this invention should be considered in light of the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

It is understood that the preceding description is given merely by way of illustration and not in limitation of the invention and that various modifications may be made thereto without departing from the spirit of the invention as claimed.

Although the invention has been described with respect to a particular system and method for its use, it will be appreciated that various modifications of the apparatus and method are possible without departing from the invention, which is defined by the claims set forth below.

What is claimed is:

1. A portable, soft-shelled carrying device comprising:

an insulated meal storage assembly holding stackable individual meal containers:

a single expandable compartment front flap (51) with closure;

a front-opening, horizontally expandable compartment which consists of five walls having no rigid panels, including: a top wall; two side walls joined to a bottom wall and joined to the top wall; and a back wall that is joined to the top wall and the side walls and that is separate from the carrying device, wherein the horizontally expandable compartment extends horizontally within the carrying device, and which accommodates the insulated meal storage assembly when the horizontally expandable compartment is expanded, and wherein said horizontally expandable compartment, when the meal storage assembly is removed, is operable to collapse entirely such that it is flush with an inner wall of the carrying device, and;

a plurality of pockets in a second chamber of the carrying device, situated separately from and outside of the horizontally expandable compartment, for storing nonperishables comprising any of the following: a book, a laptop or tablet computer, athletic apparel, and a beverage bottle.

2. The carrying device of claim 1, wherein the meal storage assembly comprises:

a) a main compartment including a compartment floor, an openable front wall, a back wall, an openable top wall, and two opposing side walls, wherein extending from the back wall to the front wall is at least one swivel partition which is permanently affixed to the back wall via a fabric hinge and which is removably affixed to a VELCRO seam on the compartment floor near the front wall;

a) a main compartment including a compartment floor, an openable front wall, a back wall, an openable top wall, and two opposing side walls, wherein extending from the back wall to the front wall is at least one swivel partition which is permanently affixed to the back wall via a fabric hinge and which is removably affixed to a VELCRO seam on the compartment floor near the front wall;

b) a fabric mesh pouch affixed to an internal surface of the back wall;

c) a fabric mesh pouch affixed to an internal surface of the top wall, and;

d) a flexible pouch affixed to the exterior surface of at least one of the side walls.

3. The carrying device of claim 1, wherein a handle is affixed to the exterior surface of a top wall of the meal storage assembly.

4. The carrying device of claim 1, wherein in the meal storage assembly a sub-pocket is affixed to an exterior surface of a front wall.

5. The carrying device of claim 2, wherein in the meal storage assembly the swivel partition is permanently affixed via any of the following: stitching; sonic welding; adhesive adherence.

6. The carrying device of claim 2, wherein in the meal storage assembly the swivel partition is removably affixed via any of the following: mating VELCRO surfaces; mating snap surfaces.

7. The carrying device of claim 2, wherein in the meal storage assembly, the fabric mesh pouch affixed to the internal surface of the back wall is operable to store temperature adjustment packets comprising any one of the following: a cooling chemical sealed within a plastic pouch, and; a heating chemical sealed within a plastic pouch.

8. The carrying device of claim 2, wherein, in the meal storage assembly, the swivel partition comprises any one of the following: soft padded thermally insulated material; hard-shell thermally insulated plastic.

9. The carrying device of claim 8, wherein in the meal storage assembly the insulated material comprises any of the following: thermal foam; polyvinyl chloride; a foil lining.

10. The carrying device of claim 1, wherein the horizontally expandable compartment has dimensions, when in the expanded position, of essentially: 7½ inches horizontally; 4½ inches vertically, and; 9 inches in width.

* * * * *